United States Patent [19]

Lincoln

[11] 4,358,180

[45] Nov. 9, 1982

[54] TWIST PIN

[75] Inventor: Thomas C. Lincoln, South Pasadena, Calif.

[73] Assignee: Malco, South Pasadena, Calif.

[21] Appl. No.: 241,547

[22] Filed: Mar. 9, 1981

[51] Int. Cl.[3] ..... H01R 13/06

[52] U.S. Cl. ..... 339/252 R

[58] Field of Search ..... 339/252 R, 252 P, 278 R

[56] References Cited

U.S. PATENT DOCUMENTS 3,255,430 6/1966 Phillips ..... 339/252 R 3,319,217 5/1967 Phillips ..... 339/252 R

*Primary Examiner*—Joseph H. McGlynn

*Attorney, Agent, or Firm*—Burns, Doane, Swecker & Mathis

[57] ABSTRACT

A pin element of the type used in a multiple pin electrical connector comprises an inner conductive portion formed of three helically wound oxygen free copper wires, and an outer conductive portion formed of a cluster of equal diameter outer wires helically wound around the inner portion for frictionally engaging a socket. From 25% to 70% of the outer wires are formed of beryllium copper and the remaining outer wires are formed of oxygen free copper to reduce engagement forces while maintaining minimum separation forces.

15 Claims, 8 Drawing Figures

Fig. 1
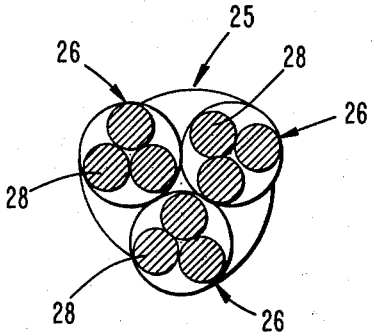
Fig. 2
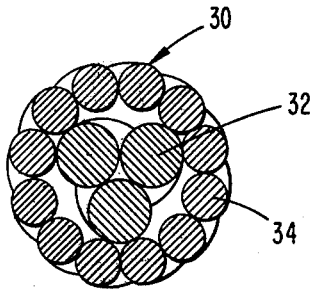
Fig. 3
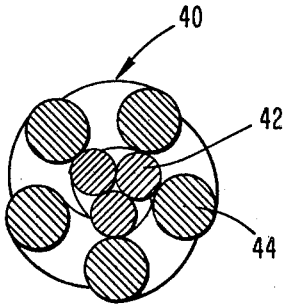
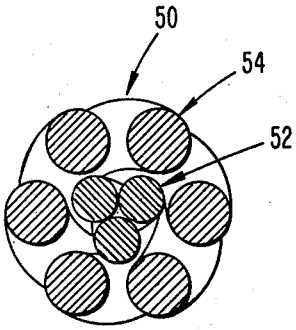
Fig. 4
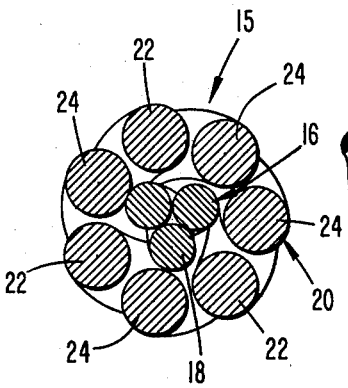
Fig. 5
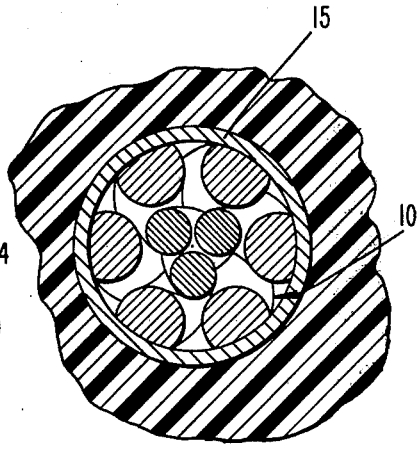
Fig. 6
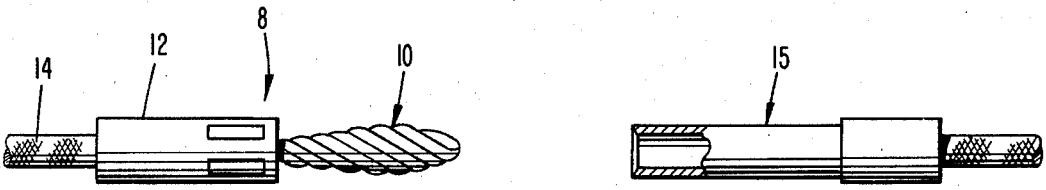
Fig. 7

TWIST PIN

BACKGROUND AND OBJECTS OF THE INVENTION

The present invention relates to electrical connectors and in particular, to contact pins for use in releasable pin and socket contacts.

Pin and socket contacts are employed in a wide variety of electrical connectors such as flat conductor cable connectors, edgeboard connectors, and connectors with coaxial cable terminations, for example. In such connectors, a series of pins are arranged on a male connector member and corresponding sockets are arranged on a female connector member. The pins and sockets are dimensioned for cooperative frictional engagement to retain the pins in place even after repeated disconnections from the sockets.

One common form of pin now in use is a so-called "twist pin" which comprises a core cable of one or more strands or wires formed of soft copper, e.g., oxygen free copper (OFC), surrounded by one or more clusters of beryllium copper (Be Cu) spring wires, the latter being helically wound around the core wires. The pin is formed such that the outer wires form a bulge intermediate the pin ends. A twist pin of this type is described, for example, in U. S. Pat. No. 3,319,217 issued to Phillips on May 9, 1967. The maximum cross-sectional area of the pin in its uncompressed state is greater than the inner diameter of the socket so that when the pin is inserted into the socket, the outer wires are resiliently compressed to produce the frictional interconnection between the pin and socket.

Beryllium copper is chosen as the material for the outer wires (i.e., the socket-engaging wires) due to its high degree of resiliency, it being felt that not only does such resiliency promote a secure mechanical engagement, but also assures a reliable electrical conductive connection as the pin rebounds to bear against the socket along a substantial interface after engagement is effected.

In practice, the forces required to engage a given pin and socket can be over 5 ounces of force per contact. While such a force per contact is not significant, per se, it will be appreciated that in a connector employing over a hundred contacts (e.g., over 184 contacts in one commercial connector), the overall mating force required to mate the male and female connector members can be very high, even when the contacts have been lubricated, thereby imposing a burden on the field personnel and or limiting, in effect, the number of contacts which are employed in a connector. Any attempt to alleviate this inconvenience must not result in a reduction in the separation force (i.e., the force needed to separate the pins) below a given minimum value (e.g., 0.5 oz.). (Otherwise, inadvertent separation of the connector may occur.) Low values suggest marginal normal force conditions which would lead to failure. Unless a minimum normal force is present, the electrical connection across the separatable interface may exhibit excessive constriction resistance.

Efforts to deal with this condition have included the examination of various non-conventional pin configurations depicted in cross-section in FIGS. 1–3. For example, coreless pins were considered in which the center or core cable is omitted. Rather, the pin comprises a plurality of helically wound cables, each cable formed of a plurality of wound wires of Be Cu of 0.0035 inch diameter (see FIG. 1). In one case, three cables of three wires each were proposed (FIG. 1); in another case three cables of four wires each were proposed; in another case four cables of three wires each were proposed. It was concluded that those designs would not solve the problem, but rather would be characterized by undesirably high engagement forces, among other disadvantages.

In another example, there were tested pins formed of a core of three helically wound wires of OFC (0.005 inch diameter) around which are helically wound 11 or 12 wires (FIG. 2) of BeCU (0.0035 inch diameter). However, undesirably high engagement forces resulted. Moreover, during the fabrication process, the outer wires would not achieve a proper bulge configuration.

In a further example, a pin was tested comprising a plurality of BeCu wires (0.005 inch diameter) helically wound around three OFC wires (0.0035 inch diameter). In one case five wires of BeCu were considered (FIG. 3); in another case three wires of BeCu were considered. Performance and quality for this type of pin were completely unsatisfactory.

It is, therefore, an object of the present invention to provide a contact pin which is characterized by reduced engagement forces, while maintaining a preselected minimum separation force.

It is another object of the invention to provide such a contact pin which does not depart from conventional pin configuration.

It is a further object of the invention to provide such a contact pin which creates ample electrical engagement with the socket.

BRIEF SUMMARY OF THE INVENTION

These objects are achieved by the present invention which involves a pin element for use in a multiple pin electrical connector which is mateable with a multiple socket electrical connector. The pin element comprises an inner conductive portion, and an outer conductive portion including a cluster of outer wires helically wound around the inner conductive portion for frictionally engaging a socket of the connector. The cluster of outer wires comprises a combination of wires having different degrees of resiliency.

Preferably, from 25% to 70% of the outer wires are formed of a material with greater resiliency.

Preferably, in a pin having seven outer wires, three thereof would be formed of beryllium copper and the others formed of oxygen free copper.

THE DRAWINGS

The objects and advantages of the invention will become apparent from the following detailed description of a preferred embodiment thereof in connection with the accompanying drawings in which like numerals designate like elements, and in which:

FIGS. 1, 2, and 3 are cross-sectional views which depict, respectively, three unsuccessful pin designs which were tested;

FIG. 4 is a cross-sectional view of one preferred pin design according to the present invention;

FIG. 5 is a cross-sectional view of another preferred pin design according to the present invention;

FIG. 6 is a view similar to FIG. 5, depicting that pin in an engaged condition within a socket;

FIG. 7 is a side elevational view, partly broken away of the pin and socket design with which the present invention deals.

DETAILED DESCRIPTION OF A PREFERRED EMBODIMENT OF THE INVENTION

Figure 8:
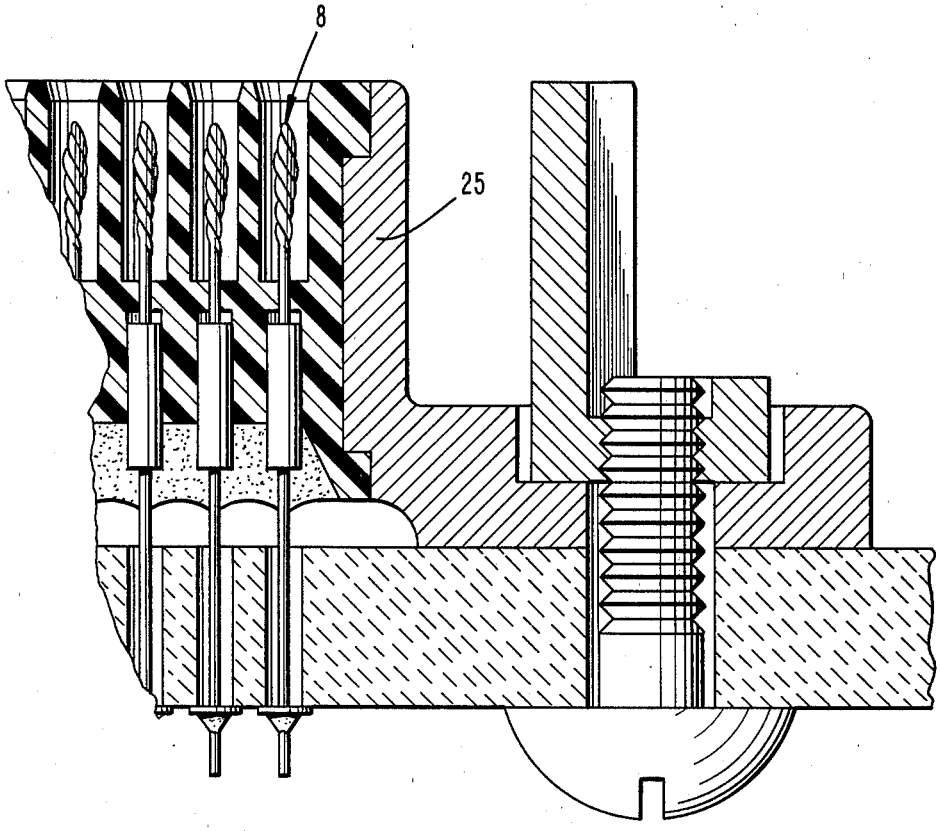
FIG. 8 is a fragmentary sectional view of a connector containing a plurality of contact pins according to the present invention.

Preferred embodiments of a twist pin 8 or contact pin according to the present invention are depicted in FIGS. 4–7. Each pin comprises a pin element 10 secured in a conventional manner within one end of an open-ended tubular ferrule 12. The ferrule is formed of a suitably electrically conductive material such as copper, preferably oxygen free copper (OFC). The other end of the ferrule is adapted to receive a wire conductor 14 soldered or crimped in place such that the ferrule electrically interconnects the wire and pin element in a customary manner.

In practice, the pin element 10 constitutes a male element which is frictionally received within a female socket 15 (see FIGS. 6–7). The internal diameter of the socket is dimensioned slightly less than the bulge diameter of the pin element to assure proper frictional engagement. The socket has an electrically conductive lead 17 connected thereto in a conventional manner.

The pin element comprises an inner or core portion and an outer portion surrounding the core portion, the latter comprising a cluster of helically wound wires. In one preferred embodiment of the invention, depicted in FIG. 5, the core portion 16 comprises three helically wound wires or strands 18. The wires 18 are formed of a soft electrically conductive material, preferably a soft copper such as oxygen free copper (OFC). The outer portion 20 of the pin depicted in FIG. 5 comprises a cluster of seven helically wound wires 22, 24, preferably of the same diameter.

As noted earlier, a pin of the above-described structural configuration is well-known wherein the seven outer wires 22, 24 would all be formed of beryllium copper (BeCu) (contrary to the present invention as discussed hereinafter). Beryllium copper is a very springy, highly resilient metal known for its use in the fabrication of springs. As also noted earlier, however, the resultant high mating forces in mult-contact pin-socket connectors employing such pins, such as the connector 25 depicted in FIG. 8, is undesirable.

The earlier-discussed efforts to alleviate this condition have failed. For example, as depicted in FIG. 1, a test pin 25 was formed of three helically wound cables 26, each cable comprising BeCu wires (0.0035 inch diameter). As depicted in FIG. 2, a test pin 30 was formed with a core of three helically wound wires 32 of OFC (0.005 inch diameter) around which are helically wound 12 wires 34 of BeCu (0.0035 inch diameter). As depicted in FIG. 3, a test pin 40 was formed with a core of three helically wound OFC wires (0.0035 inch diameter) surrounded by five BeCu wires 44 (0.005 inch diameter). In practice, however, those test pins provided unsucessful; the pins were found not to be commercially practicable. Aside from the high mating forces which resulted, there were encountered the failure of the pins to achieve the desired shape and the failure of the pins to achieve the performance and quality standards heretofore achieved in connection with long-used pin configurations.

However, it has now been discovered that the high engagement forces can be satisfactorily alleviated within a contact of standard configuration. For example, in a standard pin configuration such as depicted in FIG. 5 wherein seven outer wires 22, 24 are employed, the combination of three BeCu wires 22 with four wires 24 of a less resilient metal, preferably oxygen free copper (OFC), and of the same diameter as the BeCu wires 22, produces a pin element characterized by significantly smaller engagement forces, while maintaining the preselected minimal separation forces needed to prevent unintended separation of the pin.

The reduction in overall resiliency of the pin produced by the substitution of the less resilient metal, lessens the forces necessary to engage the pin in its socket. However, it has been found that the minimal separation forces are maintained that correspond to safe normal force levels at the electrical interface. Moreover, any loss in electrical conductivity caused by a reduction in overall area of engagement between the outer portion of the pin and the interior of the socket due to the substitution of less resilient OFC wires, is amply compensated for by an increase in overall current-carrying cability of the outer portion due to the superiority of the OFC wires over the BeCu wires in this regard. (That is, increases in "constriction resistance" are compensated for by reductions in "bulk resistance".)

In one test, comparing the present invention with the conventional use of seven BeCu wires, there were compared 24 conventional gold-plated pins (of the type similar in configuration to that depicted in FIG. 5) wherein all of the outer wires 22, 24 are formed of BeCu (0.005 inch diameter) and the inner wires 18 are formed of OFC (0.0035 inch diameter). Those high-force pins achieved the following results in a standard 24 AWG STD socket #096-0624-0000:

| | engagement force (oz.) | separation force (oz.) |
|---|---|---|
| high | 5.875 | 5.750 |
| low | 3.0 | 2.875 |
| average | 4.95 | 4.29 |

On the otherhand, 24 low-force gold-plated pins according to the present invention having four outer OFC wires 24 (0.005 inch diameter) and three outer BeCu wires 22 (0.005 inch diameter), and three inner OFC wires 18 (0.0035 inch diameter) produced the following results:

| | engagement force (oz.) | separation force (oz.) |
|---|---|---|
| high | 4.50 | 3.625 |
| low | 1.875 | 1.625 |
| average | 2.77 | 2.36 |

It will thus be appreciated that the pins according to the present invention achieved, on the average, a reduction in engagement force of from 4.95 oz. to 2.77 oz. On the other hand, no pin failed to achieve a minimum separation force of 0.5 oz. It will be appreciated that a considerable reduction in effort is needed to mate a connector having an arrangement of outer wires 22, 24 according to the present invention.

Significantly, these advantages are achieved in a pin which is of standard configuration. Thus, the pin can be fabricated by known acceptable methods and presents no new technical problems of the type which would otherwise be expected of pins having a new configuration. In this regard, attention is directed to the fabrication technique disclosed in the afore-mentioned U. S. Pat. No. 3,319,217 to Phillips, the disclosure of which is hereby incorporated by reference as if set forth at length herein.

In general, successful results are expected in accordance with the present invention if from 25% to 70% of the outer wires are of the greater resiliency. It is undesirable to fall below this ratio because the pin would then not exhibit sufficient column strength. In this regard, it should be noted, for example, that although a distribution of four OFC wires to three BeCu wires is preferred in a pin having seven outer wires, in accordance with the present invention, acceptable results may be achieved by employing from three to five OFC wires.

It will be appreciated, then, that the present invention provides a connector pin which is significantly easier to engage within a socket. This result can be achieved without departing from conventional, proven pin configurations and while maintaining ample electrical conductivity of the pin. Since proven pin configurations can be maintained, full implementation of the present invention can be made without the need to develop new fabrication methods or design new ferrules or sleeves. The behavior of the pin elements can thus be accurately predicted.

Also acceptable in accordance with the present invention is a pin 50 depicted in FIG. 4 similar but not identical to conventional prior configurations. That pin has a core 52 similar to that of the pin described in connection with FIG. 5, and containing six, rather than seven, outer wires 54 (0.005 inch diameter), wherein preferably three of the outer wires are formed of OFC and three are formed of BeCu. Acceptable results may also be obtained employing from 2 to 4 OFC wires, i.e., within the 25% to 70% range of less resilient wires.

It should be noted that in lieu of an oxygen free copper material employed in the outer wires, other suitable conductors of appropriate reduced resiliency could be used which can be soldered or welded. For example, any annealed high-percentage copper alloy would be acceptable.

Although the invention has been described in connection with a preferred embodiment thereof, it will be appreciated by those skilled in the art, that additions, modifications, substitutions, and deletions, not specifically described may be made without departing from the spirit or scope of the invention as defined in the appended claims.

What is claimed is:

1. A pin element for use in a multiple pin electrical connector which is mateable with a multiple socket electrical connector, said pin element comprising an inner conductive portion, and an outer conductive portion including a cluster of outer wires helically wound around said inner conductive portion for frictionally engaging a socket of the socket connector; said cluster of outer wires comprising a combination of wires having different degrees of resiliency.

2. A pin element according to claim 1, wherein from 25% to 70% of said outer wires are of a higher resiliency than the remaining wires.

3. A pin element according to claim 1, wherein the outer wires of the lower resiliency are of higher electrical conductivity than the outer wires of greater resiliency.

4. A pin element according to claim 1, wherein the outer wires of the higher resiliency are formed of beryllium copper and the outer wires of lower resiliency are formed of oxygen free copper.

5. A pin element according to claim 1, wherein there are seven outer wires, from 2 to 4 of said outer wires being of higher resiliency than the remaining outer wires.

6. A pin element according to claim 5, wherein said higher resiliency wires are formed of beryllium copper, and said wires of lower resiliency are formed of oxygen free copper.

7. A pin element according to claim 6, wherein outer wires of less resiliency are of higher electrical conductivity than the remaining outer wires.

8. A pin element according to claim 1, wherein there are six outer wires, three of said outer wires being formed of higher resiliency than the remaining wires.

9. A pin element according to claim 8, wherein three of said outer wires are formed of beryllium copper and the remaining three are formed of oxygen free copper.

10. A pin element for use in a multiple pin electrical connector which is mateable with a multiple socket electrical connector, said pin element comprising:

an inner conductive portion formed of three helically wound oxygen free copper wires, and an outer conductive portion formed of a cluster of equal diameter outer wires helically wound around said inner portion for frictionally engaging a socket, from 25% to 70% of said outer wires formed of beryllium copper and the remaining outer wires formed of oxygen free copper.

11. A pin element according to claim 10, wherein there are 3 beryllium copper outer wires and 4 oxygen free copper outer wires.

12. A pin element according to claim 10, wherein there are 3 beryllium copper outer wires and 3 oxygen free copper outer wires.

13. A multiple pin electrical connector of the type which is mateable with a multiple socket electrical connector, said multiple pin electrical connector comprising:

a housing, a plurality of pins mounted in said housing, each comprising a ferrule and a pin element projecting therefrom, each pin element comprising:

an inner conductive portion, and an outer conductive portion including a cluster of equal-diameter outer wires helically wound around said inner portion for frictionally engaging a socket, said cluster of outer wires comprising a combination of wires having different degrees of resiliency.

14. An electrical connector according to claim 13, wherein from 25% to 70% of said outer wires are of a greater resiliency than the remaining outer wires.

15. An electrical connector according to claim 14, wherein said outer wires of greater resiliency are formed of beryllium copper and the remaining outer wires are formed of oxygen free copper.

* * * * *